US010334937B2

(12) United States Patent
Lane

(10) Patent No.: US 10,334,937 B2
(45) Date of Patent: Jul. 2, 2019

(54) LID ASSEMBLY WITH RING TO CONTROL FLOW

(71) Applicant: THERMOS L.L.C., Schaumburg, IL (US)

(72) Inventor: Marvin Lane, Wheeling, IL (US)

(73) Assignee: THERMOS L.L.C., Schaumburg, IL (US)

( * ) Notice: Subject to any disclaimer, the term of this patent is extended or adjusted under 35 U.S.C. 154(b) by 246 days.

(21) Appl. No.: 15/092,818

(22) Filed: Apr. 7, 2016

(65) Prior Publication Data

US 2016/0296050 A1 Oct. 13, 2016

Related U.S. Application Data

(60) Provisional application No. 62/144,881, filed on Apr. 8, 2015.

(51) Int. Cl.
*A47G 19/22* (2006.01)
*A45F 3/18* (2006.01)

(52) U.S. Cl.
CPC ..... *A45F 3/18* (2013.01)

(58) Field of Classification Search
CPC .. B65D 47/244; B65D 47/242; B65D 47/266; B65D 2251/0003; B65D 2251/0015; B65D 47/122; B65D 47/246; B65D 2251/0056; A45F 3/18
USPC ..... 222/521, 548
See application file for complete search history.

(56) References Cited

U.S. PATENT DOCUMENTS 2,149,906 A * 3/1939 Bell ..... B65D 39/084 220/304
4,497,422 A * 2/1985 Klees ..... B65D 47/246 222/482
6,814,267 B2 * 11/2004 Ingram ..... B67D 7/005 222/520
8,376,186 B2 * 2/2013 Wang ..... B05B 11/0027 222/145.1
8,636,166 B2 * 1/2014 Lane ..... B65D 47/242 215/228
2006/0180585 A1 * 8/2006 Cunningham ..... A47G 19/2266 220/203.06

* cited by examiner

*Primary Examiner* — Paul R Durand
*Assistant Examiner* — Robert K Nichols, II
(74) *Attorney, Agent, or Firm* — Polsinelli PC

(57) ABSTRACT

A lid assembly for a beverage container is described. The lid assembly includes an outer ring, a spout, and a base member. The outer ring is rotated by the user to drive the spout toward the base member. The movement of the spout opens and closes openings or fluidic passages of the lid assembly.

17 Claims, 12 Drawing Sheets

LID ASSEMBLY WITH RING TO CONTROL FLOW

CROSS REFERENCE TO RELATED APPLICATION

This application claims the benefit of U.S. Provisional Patent Application 62/144,881 filed Apr. 8, 2015, which is hereby incorporated by reference.

FIELD OF INVENTION

The present invention relates to a lid assembly with a ring for a beverage container, with the ring to control the flow of a liquid through the lid assembly.

DESCRIPTION OF RELATED ART

A user often wishes to manage the flow of a liquid out of a container to avoid spilling or otherwise pouring out or drinking more liquid than intended. For example, if a beverage is warm or hot, the user may only want a small sip to test the temperature or otherwise avoid burning their mouth, lips, or tongue. There are many different types of spouts to facilitate managing a flow of a liquid out of a container. Some flow-managing spouts, such as retractable spouts, require the user to use their fingers to pull out or push in the spout portion that the mouth will touch, which creates concerns about hygiene. Other flow-managing spouts require a separate cap piece to stop the flow and to keep the spout clean, which is an extra step for the users to remove and properly position the cap and often more expensive to add this piece for the manufacturers. Still other flow-managing spouts require a more complicated construction possibly including a coiled spring actuating a screw cap and an air venting tube. These retractable spouts in the prior art generally require many parts, require more complicated manufacturing processes, and may not promote hygienic use of the products.

In addition, users sometimes want to flavor, infuse, or otherwise treat a beverage with fruit, herbs, ice, or other flavor additive. Accordingly, some containers are configured specifically to hold such additives in the container, but are constructed to block the additive from exiting the container. For example, some such containers include a "cage" type construction, possibly suspended from the lid. The cage holds the additive and exposes the liquid (usually water) to the additive without permitting the additive to exit the container while the user is drinking. Another example of a container configured for infusion includes a first container that is connectable to a second container, where a strainer is positioned between the containers and the strainer blocks the additive from exiting the first container while the user is drinking. However, these extra parts—the cage or strainer or second container—add additional pieces to be cleaned and maintained by the user and also may add to manufacturing costs.

Clearly, there is a demand for a single lid for managing flow of liquid therethrough with the capability of controlling additives with a compact lid construction. The present invention satisfies this demand.

SUMMARY OF INVENTION

A beverage container system is described. The beverage container may include a lid assembly for a beverage container and, optionally, a beverage container as well. The lid assembly includes an outer ring, a spout, and a lid main body. The outer ring is rotated by the user to drive the spout toward and away from the lid main body. The movement of the spout opens and closes—or, in other words, blocks or unblocks—openings or fluidic passages of the lid assembly that are formed in the lid main body. The lid main body may include or be comprised of a base member that generally remains stationary relative to the beverage container. Both the spout and the outer ring may move relative to the base member. In some aspects, the base member includes both an inner member and an outer member, while in other aspects, the base member is a single piece construction. The lid assembly controls the flow of the liquid from the container without the need to directly touch the spout, which improves the sanitary use of the spout since user drinks the liquid directly from the spout.

The lid assembly includes a spout, which may be retractable and extendable by rotation of the outer ring to control the amount of the fluid passing through the spout. The lid assembly requires a minimal number of parts to retract and extend the spout, provides infinite or variable flow control, and relieves the concerns of hygiene because direct touch of the spout can be avoided. In addition, the openings created by the lid assembly are configured to be generally small enough that fruit, ice, and other relatively chunky additives will generally not pass through, thereby permitting the use of such additives in the container to treat/flavor the beverage without the user actually consuming them.

In certain aspects, the lid assembly includes openings positioned all the way around the circumference of the lid, such that the user can comfortably and safely drink from any angle.

In one aspect, the present application overcomes problems inherent in the prior art and provides a lid assembly including an outer ring removably engaged to a spout having a seal. The seal is configured to minimize unintended leakage of liquid between the spout and the outer ring. The spout is operatively engaged to a base member having a base side wall, such as a bore, and a bottom surface that defines openings. The base side wall and the bottom surface may be integrally or piecemeal connected via one or more flanges. The space between the bottom of the base side wall, the outer circumference of the bottom surface, and the side edges of the flanges defines openings through which the liquid may flow. The beverage container system of the present application also provides a method for controlling the flow of liquid and additives, either infinitely or according to pre-settings.

In certain aspects, the bottom surface includes a gasket or forms a supportive surface for a gasket. The gasket may be adhered to or attached to the bottom surface.

In another aspect, a lid assembly for a beverage container is configured to achieve an open position to permit a user to drink liquid therethrough and to achieve a closed position that generally limits the liquid passage therethrough. The lid assembly includes a spout having a mouth portion and a lower circular end positioned generally opposite the mouth portion, wherein the mouth portion is configured to receive the user's lips. The lid assembly includes a base member having a bottom surface, a base side wall, and flanges, wherein the bottom surface, the base side wall, and the flanges define openings that permit passage of liquid when the lid assembly is in the open position and wherein the lower circular end of the spout meets with the bottom surface to block the passage of liquid through the openings when the lid assembly is in the closed position. The lid assembly includes an outer ring configured to permit the user to maneuver the spout and the base member relative to each other to achieve the open position and the closed position, such that the user does not have to directly touch the spout to achieve either position, which decreases contamination of the mouth portion of the spout. The openings are sized and shaped to generally block the passage of relatively chunky additives therethrough, even when the lid assembly is in the open position.

In another aspect, a lid assembly includes base member. The base member forms a base side wall such as a bore with an internal bore surface. One or more openings are defined between the base side wall and the flanges. The base member includes a first protruding edge, which forms a receiving member. The lid assembly includes an outer ring to rotatably engage with the base member. The outer ring forms an engaging member. A spout is rotatably engaged with the base member. The spout includes a mouth portion, an internal cylindrical surface, an external cylindrical surface, and a lower circular end generally opposite of the mouth portion. The spout includes a second protruding edge, which includes a receiving member. A seal extends from the external cylindrical surface of the spout to seal against the internal bore surface of the base member. The engaging member of the outer ring engages with the receiving member of the base member and the receiving member of the spout. The outer ring rotates the spout relative to the base member to move the lower circular end towards and away from the opening of the base member.

In another aspect, the lid assembly includes a base member, an outer ring including at least one engaging member, a spout including a seal, a protruding outer edge that pairs with the engaging member of the outer ring, an engagement section, and a lower circular end. A base member includes a pairing engagement section matching the engagement section of the spout, a bottom surface having a flange with openings, and a gasket supported by the bottom surface, and a passage is formed by the openings of the flange, the lower circular end of the spout, and the gasket supported by the flange. The outer ring is engaged to the spout through fitting the engaging members of the outer ring to the protruding outer edge of the spout. The engagement section of the spout is received by the pairing engagement section of the base member. The spout moves upward or downward by rotation of the outer ring. The spout moves to open or close the passage to allow or stop liquid or air flow through the passage.

In another aspect, the lid assembly includes a base member, an outer ring including at least one engaging member, a retractable and extendable spout including an internal cylindrical surface, a mouth portion, a protruding outer edge, a receiving member on the protruding outer edge that pairs with the engaging member of the outer ring, an engagement section, a seal, a groove that holds the seal, and a lower circular end. The base member includes a pairing engagement section matching the engagement section of the spout, a smooth bore section, a bottom having a flange with openings, and a gasket supported by the flange. A passage is created by the openings of the flange, the lower circular end of the spout, and the gasket supported by the flange. The outer ring is engaged to the spout through fitting the engaging members of the outer ring into the receiving members of the spout. The spout is received by the base member at the engagement section of the spout and the base member. Movement of the spout is controlled by turning the outer ring. The spout movement opens or closes the passage to allow or stop liquid or air flow. When retracted, in some aspects, the mouth portion of the spout is leveled with or underneath the top of the outer ring.

Another aspect of the present application provides a lid assembly with a spout that controls the flow of liquid through the spout infinitely or according to a presetting.

Another aspect of the present application provides a lid assembly with a spout that includes an outer ring removably engaged to the spout. The outer ring may be removably engaged to the spout by, for example, tabs, clips, wedges, or any other methods known in the art.

Another aspect of the present application provides a lid assembly with a spout having the engagement sections of the spout and the base member threaded, such that the base member receives the spout by a rotational motion. One of skill in the art understands there are other methods of engagement of the spout and the base member that are applicable for the purpose of the present disclosure.

Another aspect of the present application provides a lid assembly with a spout having the base member containing a smooth bore section that allows the seal of the spout to rub against the surface of the bore section when the spout moves.

Another aspect of the present application provides a lid assembly with a spout having an angular seal or a radial seal held in the groove on the outer surface of the spout. In one particular embodiment, the seal on the spout is a double lip seal.

Another aspect of the present application provides a lid assembly with a spout having a flange at the bottom of the base member that includes a plural number of ribs for creating openings at the bottom of the base member.

Another aspect of the present application provides a lid assembly with a spout that contains an air and fluid passage that can be closed when the lower circular end of the spout presses against the gasket of the base member. The passage can be opened when the lower circular end of the spout is moved away from the gasket of the base member. When the passage is closed, the flow of the liquid and air through the passage are partially or completely stopped. When the passage is opened, the flow of the liquid and air through the passage are allowed in an amount depending on the extent of the movement of the spout controlled by turning the outer ring of the lid.

All aspects and embodiments of the disclosure can comprise, consist essentially of, or consist of any aspect or embodiment or combination of aspects and embodiments disclosed herein.

Other aspects, embodiments, and iterations of the lid are described in more detail below.

DETAILED DESCRIPTION

Figure 2:
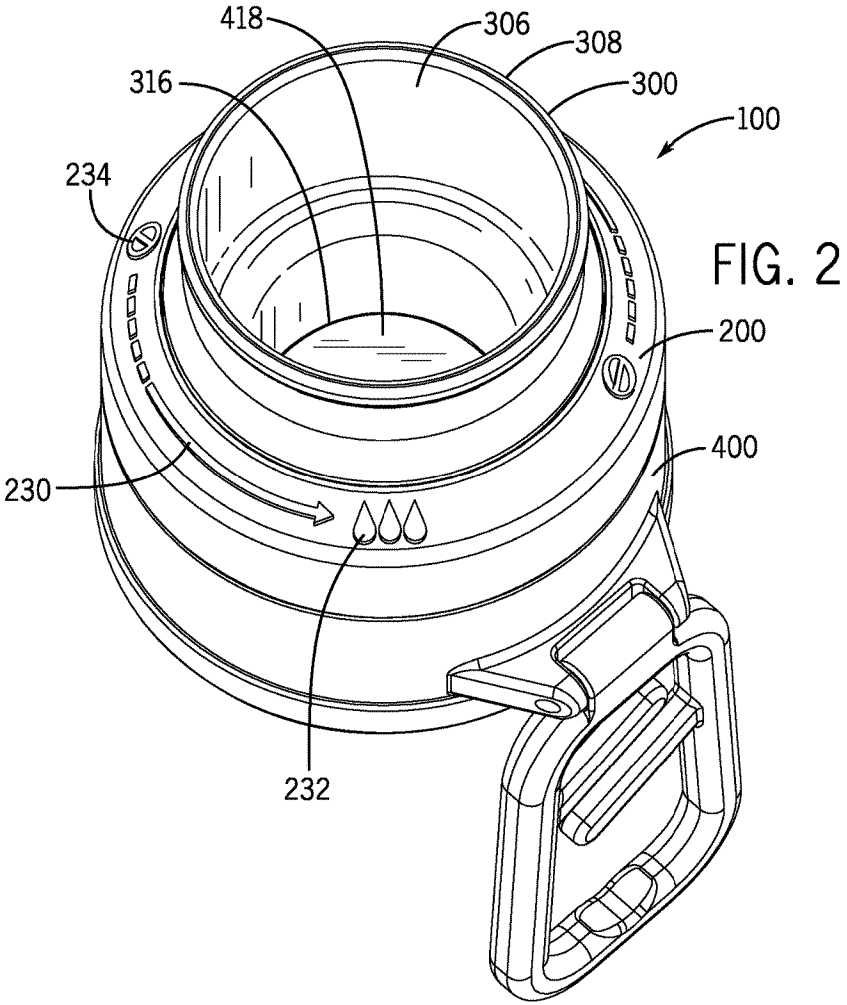
FIG. 2 is a perspective view of an embodiment of the lid assembly.
Figure 1:
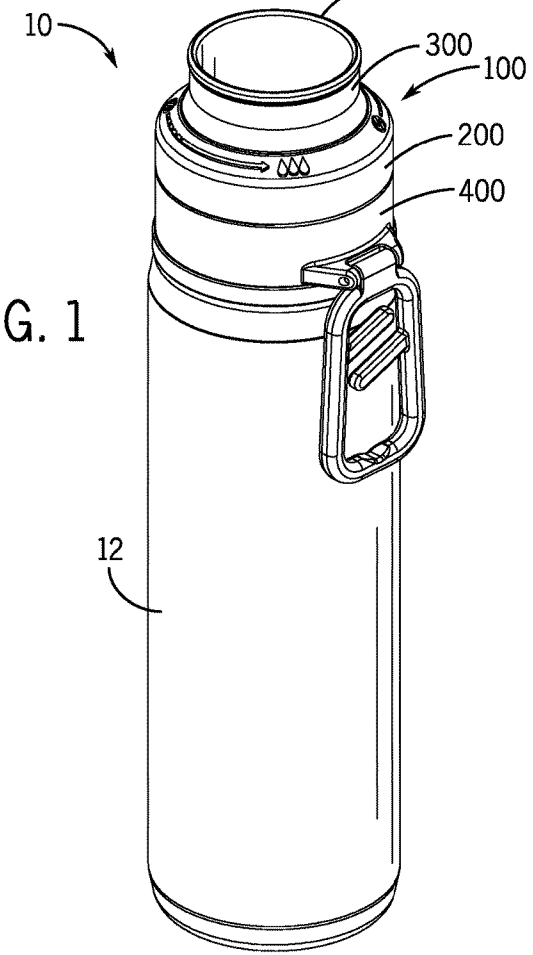
FIG. 1 is a perspective view of an embodiment of the beverage container with the lid assembly.
Figure 3:
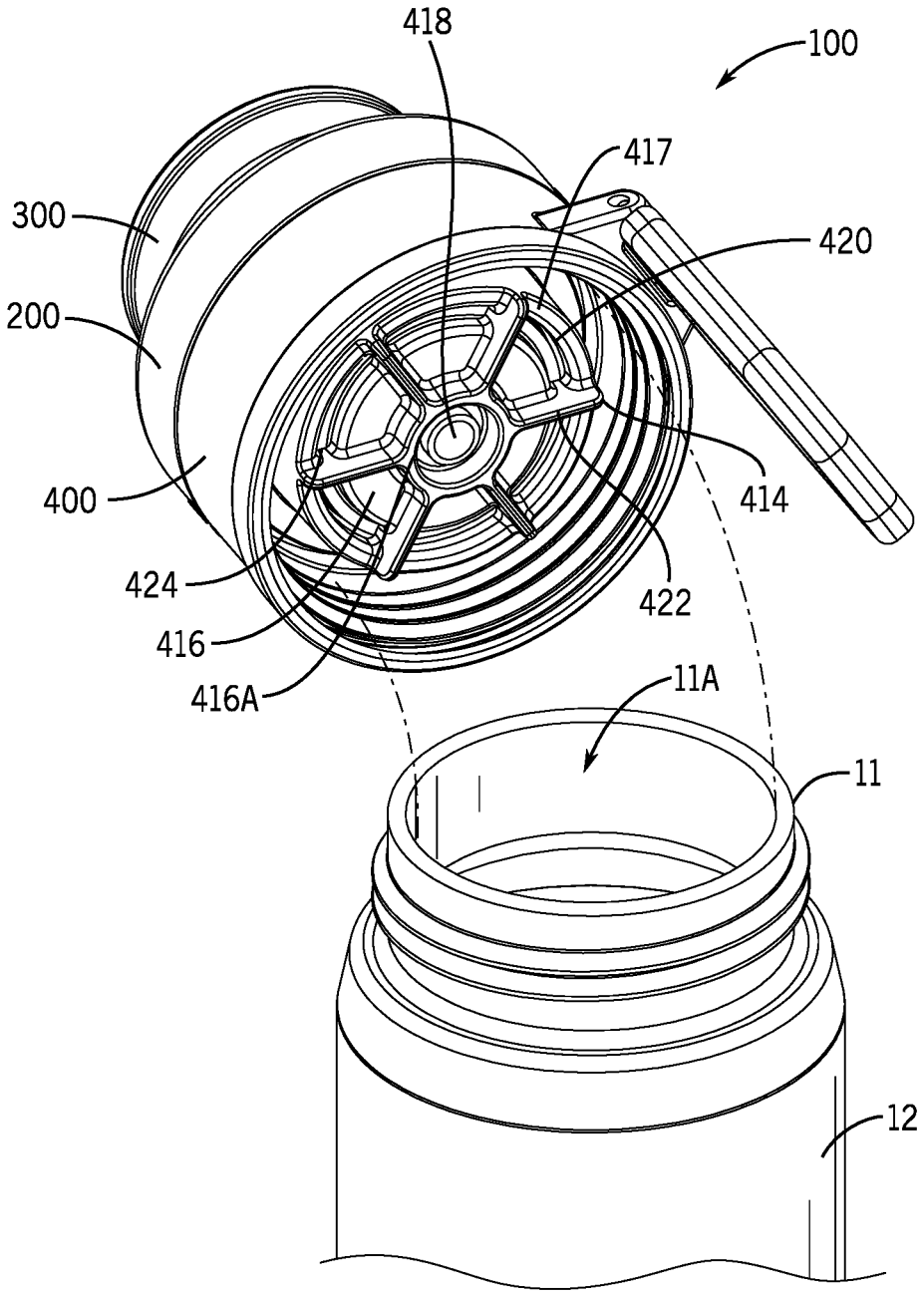
FIG. 3 is a perspective view of an embodiment of the lid assembly engaging to the beverage container.
Figure 4A:
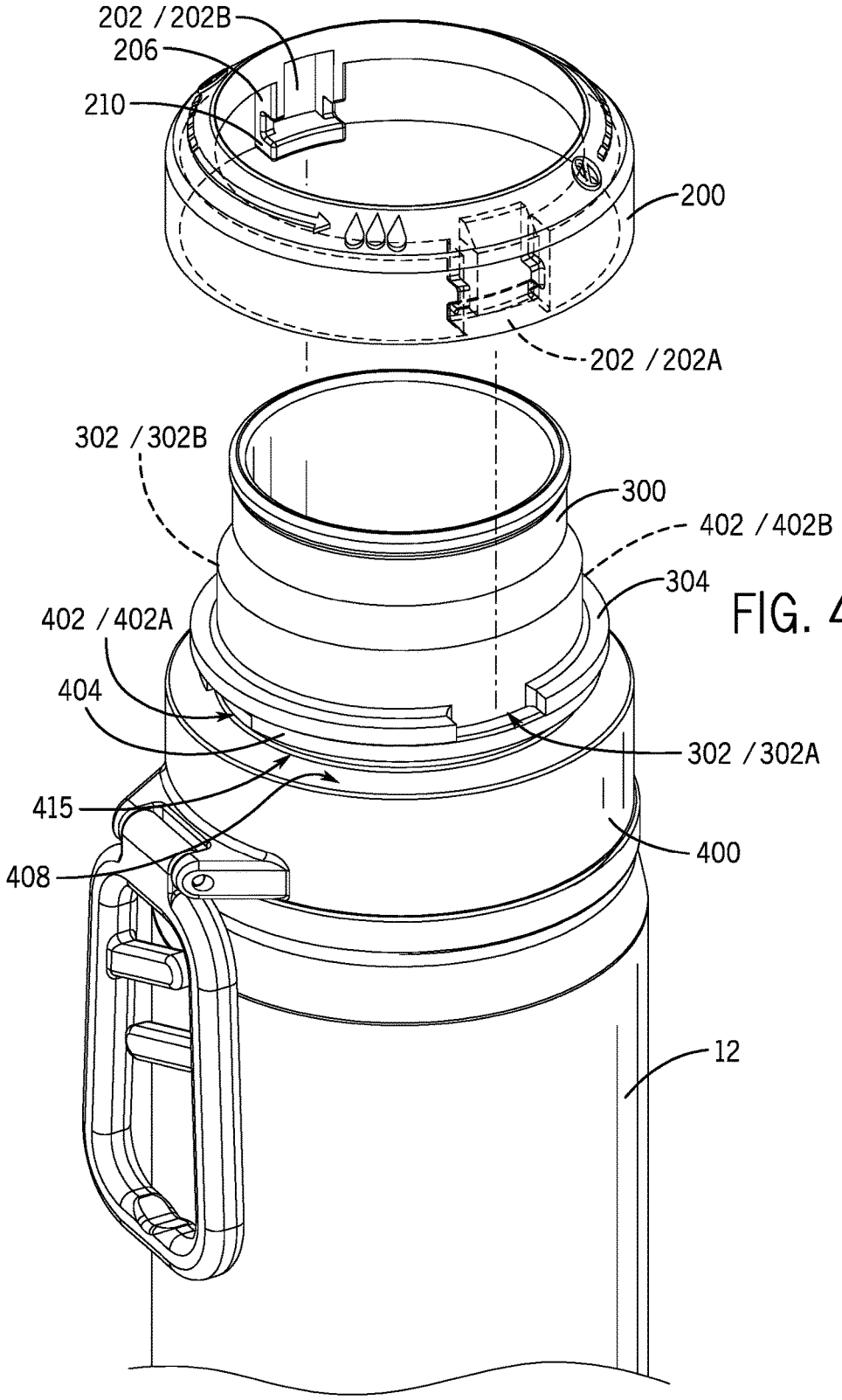
FIG. 4A is a perspective view of an embodiment showing the outer ring detached from the lid assembly.
Figure 4B:
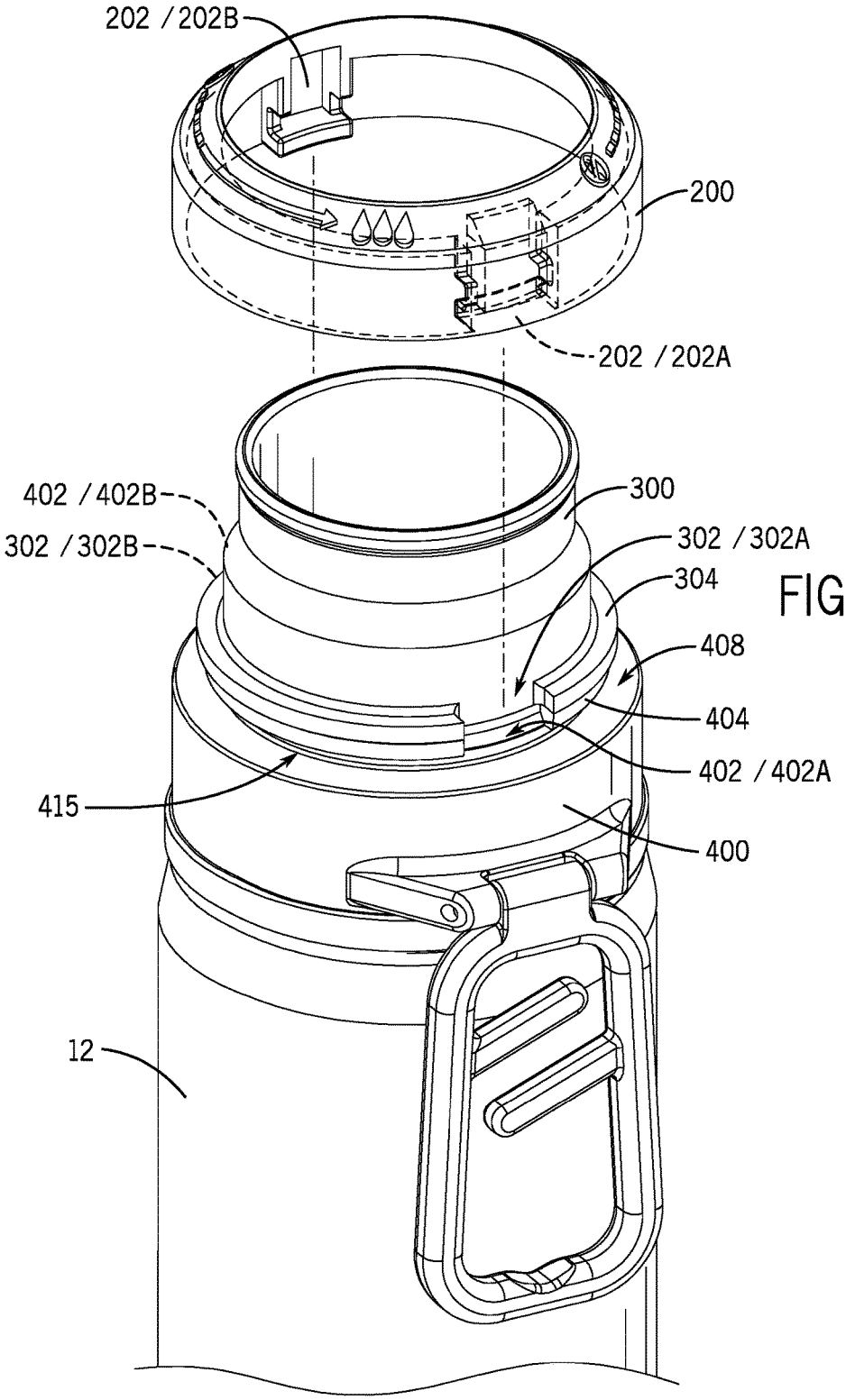
FIG. 4B is a perspective view of an embodiment showing the outer ring detached from the lid assembly with engaging members lined up with the receiving members.

For purposes of this application, any terms that describe relative position (e.g., "upper", "middle" "lower", "outer", "inner", "above", "below", "bottom", "top", etc.) refer to an embodiment of the invention as illustrated, but those terms do not limit the orientation in which the embodiments can be used.

In FIG. 1 through FIG. 10, a numerical symbol "10" represents, as a whole, a beverage container system of the present disclosure. The beverage container system 10 includes a container main body 12 and a lid assembly 100. The container main body 12 includes a container mouth 11 defining a container opening 11A. The lid assembly 100 includes an outer ring 200, a spout 300, and a base member 400. The lid assembly 100 opens and closes the container main body 12 to prevent or allow the flow of liquid from the container main body 12. The lid assembly 100 engages to the container main body 12 via a threaded engagement, snap-fit connection, frictional connection, compression connection, bayonet connection, or the like.

The base member 400 is engaged to the container main body 12, and after engagement, the base member 400 generally remains stationary relative to the main body 12 to hold the remainder of the lid assembly 100 to the main body 12. Of course, the lid assembly 100 may be removed from the main body 12 for filling the main body 12 with a liquid for drinking, cleaning, storage, etc. The outer ring 200 and the spout 300 are rotatably engaged to the base member 400. The user rotates to the outer ring 200 to open and close the lid assembly 100 such that liquid can pass through the lid assembly 100 when the outer ring 200 is in an open position and liquid is generally blocked from passing through the lid assembly 100 when the outer ring 200 is in the closed position. In certain aspects, the outer ring 200 and the spout 300 may also be completely disengaged from the base member 400, for example, for cleaning purposes.

In order to drink from the lid assembly 100, a user rotates the outer ring 200 relative to the base member 400 to open and close the lid assembly 100. The rotation of the outer ring 200 relative to the base member 400 causes the spout 300 to rotate to the open or closed positions. As shown in the aspect of FIGS. 1-10, a clock-wise rotation of the outer ring 200 causes the spout 300 to likewise rotate in the clock-wise direction toward the closed position, and a counter clock-wise rotation of the outer ring 200 causes the spout 300 to rotate in the counter clock-wise direction toward the open position.

As the user rotates the spout 300 in the clock-wise direction toward the closed position, a lower portion of the spout 300 is urged against a sealing surface of the base member 400 to block or occlude the liquid from flowing out of the container main body 12. As the spout 300 is rotated in the counter clock-wise direction toward the open position, the lower portion of the spout 300 is moved away from the sealing surface of the base member 400 to open or allow the liquid to flow out of the container main body 12. As used herein, the term "spout" encompasses any of a variety of drinking apertures for user to drink from, such as for example, lids with openings, nozzles, enlarged straws, caps with a drinking opening, etc.

The outer ring 200 and the spout 300 are engaged to the base member 400 by one or more engaging members. The engaging members may include tabs, clips, wedges, or any other methods known in the art. The engaging members may be detachable or removable in order to disassemble the outer ring 200 and the spout 300 from the base member 400.

In some aspects, the outer ring 200 contains at least one engaging member 202 that fits into a matching or complementary receiving member 302 on a protruding outer edge 304 of the spout 300. By fitting the outer ring 200 to the spout 300 through the matching engaging member 202 and receiving member 302, the outer ring 200 is engaged onto the spout 300 and is capable of driving the spout 300 outward (or upward) and inward (or downward) by turning the outer ring 200. The receiving member 302 may include an opening, slot, recess, etc. in the protruding outer edge 304 of the spout 300. The moving distance of the spout 300 is controllable by the extent of the turning of the outer ring 200. The base member 400 includes a receiving member 402, which may be an opening, slot, recess, etc. in a protruding edge 404 of the base member 400.

With reference to FIG. 2, the outer ring 200 may include optional open and close directional indicators such as, for example, symbols, numbers, words, letters, bumps, protrusions, indicia, etc. to indicate to the user whether the beverage container system 10 is open, closed, to what extent the bottle system 10 is open or closed, and/or which direction the outer ring 200 should be rotated in order to open or close the beverage container system 10. In the aspect of FIGS. 1-10, for example, an arrow 230, droplets 232, and a cross bar 234 are on the surface of the outer ring 200. These optional elements indicate to the user that the outer ring 200 should be turned counter clockwise (toward the droplets 232) to open the beverage container system 10 and that the outer ring 200 should be turned clock-wise (toward the cross bar 234) to close the beverage container system 10.

The interaction of the engaging member 202 of the outer ring 200 with the receiving member 302 of the spout 300 and the receiving member 402 of the base member 400 locks the spout 300 and the outer ring 200 to the base member 400, yet the spout 300 and the outer ring 200 may be unlocked and disassembled for cleaning, at least in certain aspects. The engaging member 202 forms a key-like structure that engages with the spout receiving member 302 of the spout 300 and the base receiving member 402 of the base member 400. As described below in greater detail, the engaging member 202 is held in a rotatable engagement with structures of the base member 400.

Figure 5:
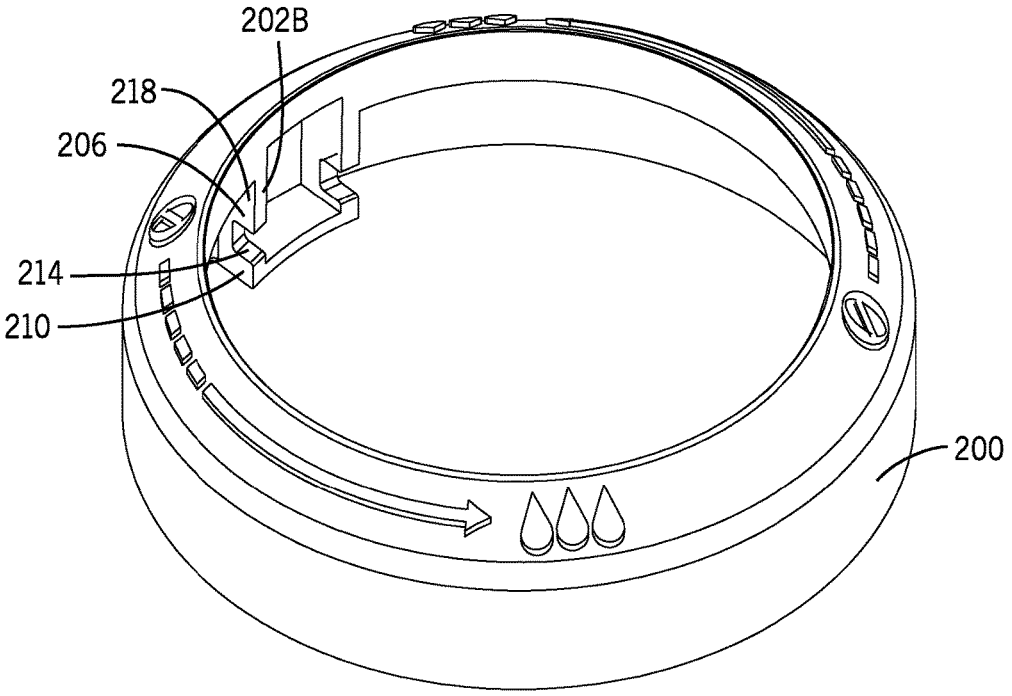
FIG. 5 is an enlarged perspective top view of an embodiment showing the outer ring and the engaging members.
Figure 6:
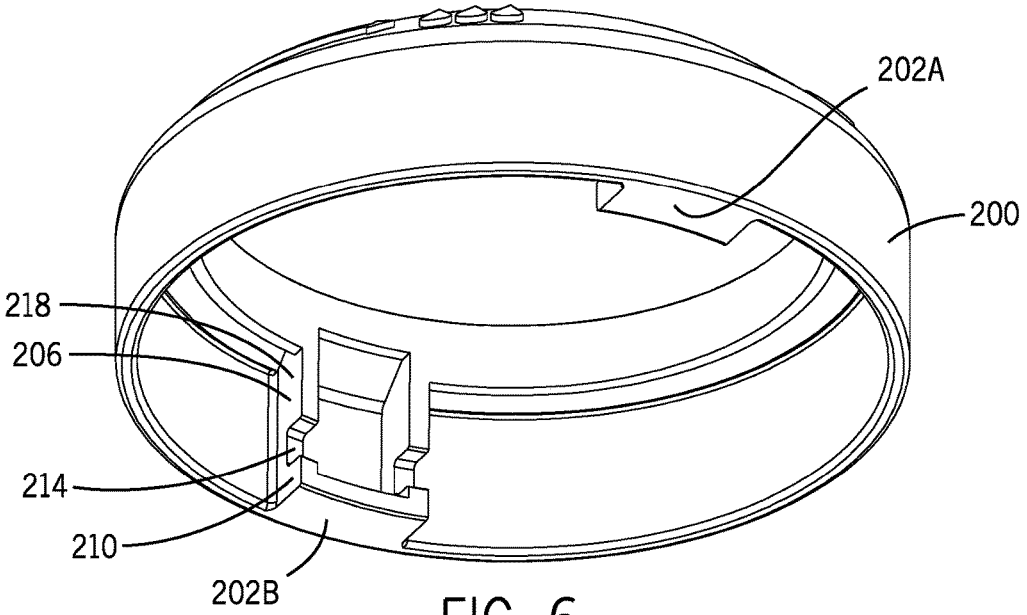
FIG. 6 is an enlarged perspective bottom view of an embodiment showing the outer ring and the engaging members.

With reference to FIGS. 5 and 6, the engaging member 202 includes an upper member 206 and a lower member 210 that form a slot 214. When the outer ring 200 is rotated by the user, a side surface 218 of the upper member 206 pushes against the receiving member 302 of the spout 300 causing the rotation of the spout 300. In the aspect shown FIGS. 1-10, a first engaging member 202A is generally opposite of a second engaging member 202B, a first receiving member 302A is generally opposite of a second receiving member 302B, and a first receiving member 402A is generally opposite of a second receiving member 402B.

As the outer ring 200 is fitted to the spout 300, the engaging member 202 passes through the receiving member 302. Next, the engaging member 202 passes through the receiving member 402 in the protruding edge 404 of base member 400 to position the lower member 210 of the engaging member 202 on or just above an outer surface 408 of the base member 400. A groove 415 is formed between the outer surface 408 and the protruding edge 404. The groove 415 forms a smaller outer diameter than an outer diameter of the protruding edge 404. The groove 415 receives the lower member 210 of the engaging member 202 in a sliding engagement for rotation, while the slot 214 of the engaging member 202 receives the protruding edge 404 of the base member 400 in a sliding engagement for rotation. The upper member 206 is on top or just above a top surface of the protruding edge 404. As the outer ring 200 is rotated, the lower member 210 travels in the groove 415. When the lower member 210 is rotated past the receiving member 404, the lower member 210 locks the outer ring 200 and the spout 300 to the base member 400. Similar to the receiving member 302, the receiving member 402 may include an opening, slot, recess, etc. in the protruding outer edge 404 of the base member 400.

With reference to FIGS. 7-10, the spout 300 includes an internal cylindrical surface 306, a mouth portion 308, the protruding outer edge 304, the receiving member 302 on the outer edge 304 to removably engage to the matching engaging member 202, an engagement section 310 that matches with the pairing engagement section 410 of the base member 400, a groove 314 to hold a seal 312, and a lower circular end 316. In some aspects, the engagement section 310 is threaded, as such the pairing engagement section 410 of the base member 400 is also threaded to receive the spout 300 by a rotational motion. In some aspects, the seal 312 of the spout 300 is an angular seal or a radial seal. In some aspects, the seal 312 of spout 300 is a gasket with lips extending outward. In one particular aspect, the seal 312 is a double-lip seal.

On its inner surface, the base member 400 contains a pairing engagement section 410, a base side wall 417 forming a bore 411 and internal bore surface 412, a flange 414 extending adjacent to a bottom surface 416 of the base member 400, and a gasket 418. The base member 400 defines the bore 411 to receive the spout 300. The internal bore surface 412 is generally smooth. The seal 312 is held in the groove 314 of the spout 300 and rubs against the internal bore surface 412 when the spout 300 moves. The bore 411 receives the lower circular end 316 of the spout 300. The base member 400 also includes threaded engagement surface 430 for installing the lid assembly 100 over the container opening 11A of the container main body 12. The height of the bore 411 may be adjusted to determine how far the spout 300 can move beyond the distance created by the threaded engagement section 310 and 410.

The flange 414 and the bottom surface 416 provide support to the gasket 418. Specifically, in the aspect illustrated in FIGS. 7-8, the bottom surface 416 is generally circular, with a gasket receiving opening 416A configured to receive a lower portion of the gasket 418 to maintain the gasket 418 in position relative to the bottom surface 416. The flanges 414 connect to the base side wall 417, thereby defining openings 420 around the bottom surface 416 of the base member 400 (between the bottom surface 416 and the base side wall 417 when the lid assembly 100 is open). In some aspects, the flange 414 includes a plurality of ribs 422. The relative size of the openings 420 may be varied to regulate flow of liquid and air to and from the container main body 12. More specifically, the amount of blockage provided by the lower circular end 316 is changed, thereby changing the size of the openings 420.

The gasket 418 may be integral with or a separable piece with the bottom surface 416. Also, the bottom surface 416 may be integral with or a separable piece from the base side wall 417.

Figure 8:
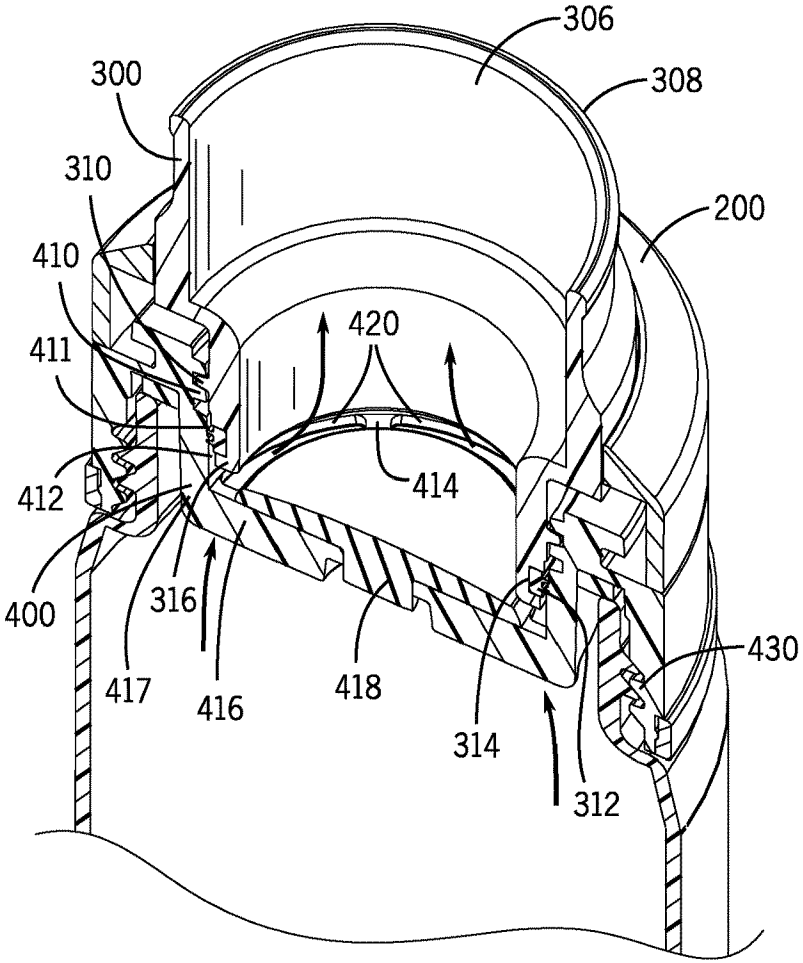
FIG. 8 is a cross-sectional view of an embodiment showing that the spout is moved upward and away from the gasket to expose the openings.
Figure 7:
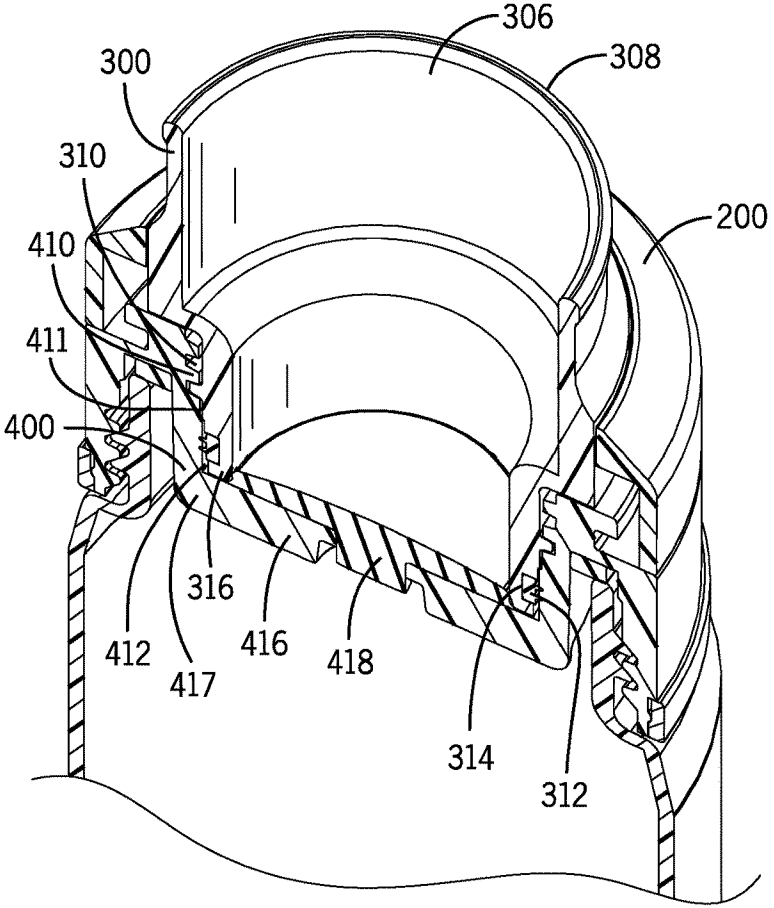
FIG. 7 is a cross-sectional view of an embodiment showing that the spout is moved downward and pressed against the gasket to close the openings.
Figure 10:
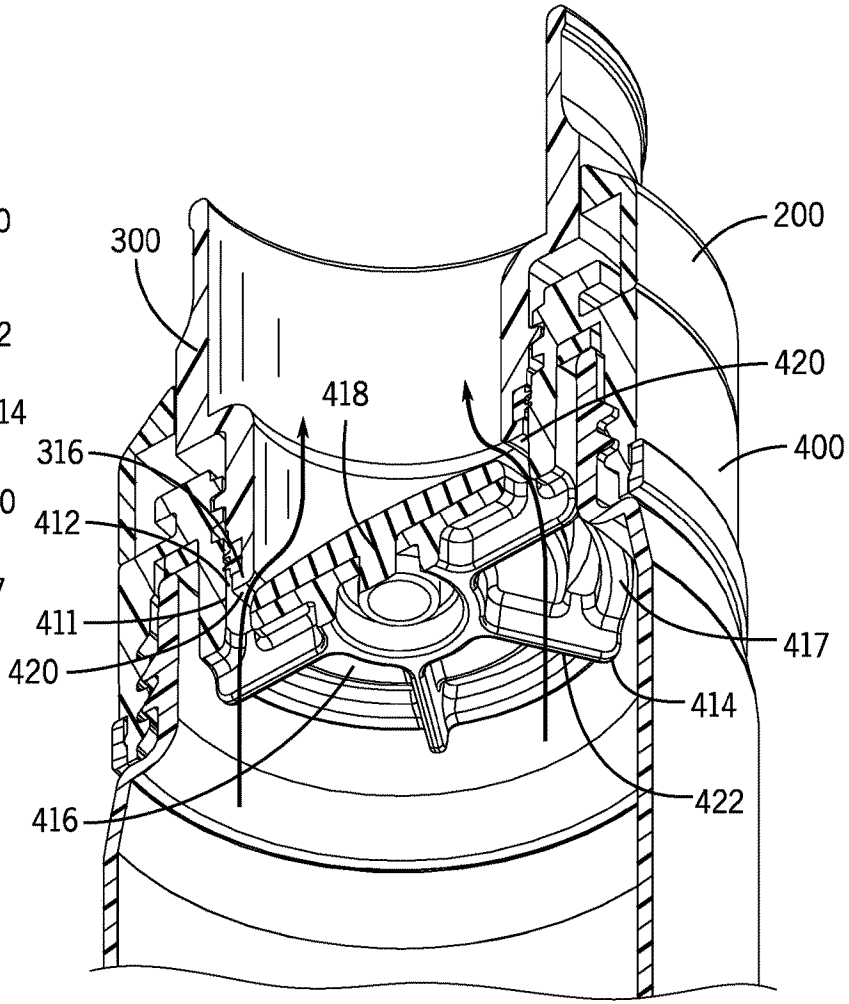
FIG. 10 is a partial cross-sectional view of an embodiment showing the spout is moved upward and away from the gasket to expose the openings.
Figure 9:
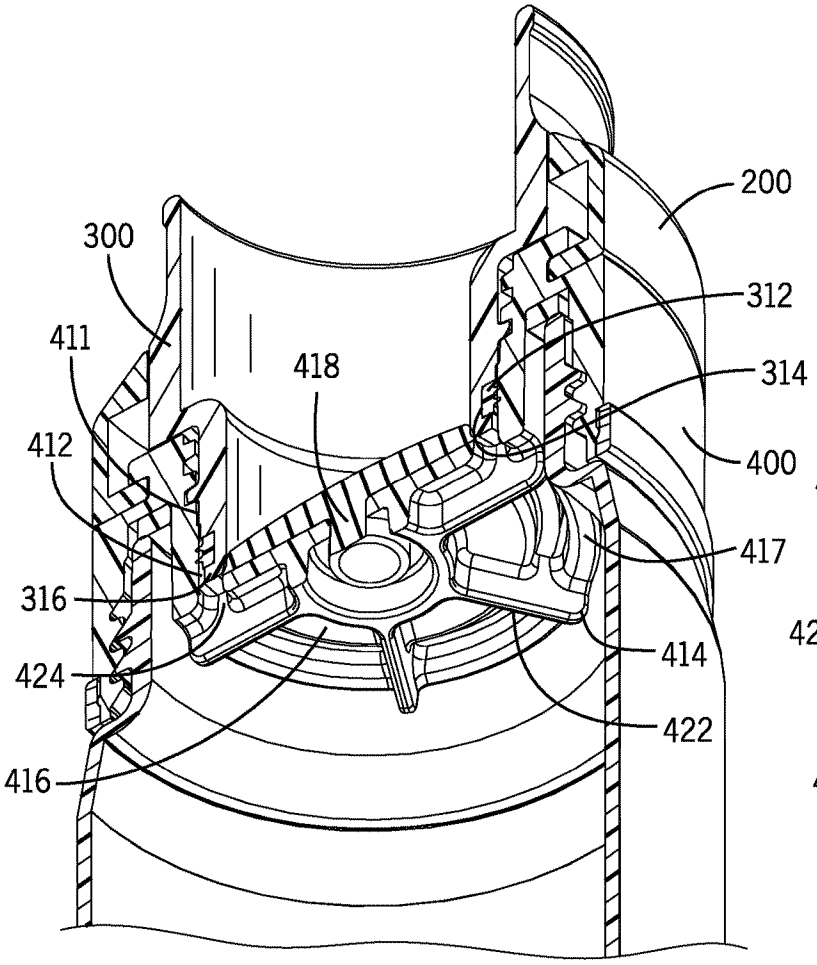
FIG. 9 is a partial cross-sectional view of an embodiment showing that the spout is moved downward and pressed against the gasket to close the openings.
Figure 12:
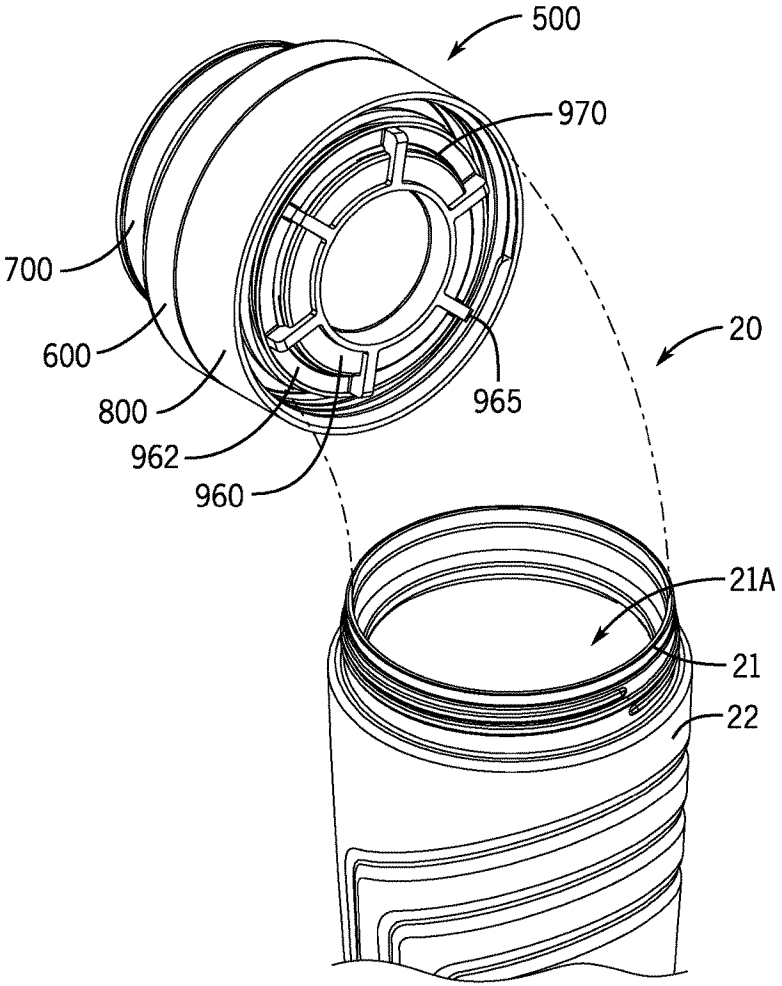
FIG. 12 is a perspective view of another embodiment of the lid assembly engaging to the beverage container.
Figure 11:
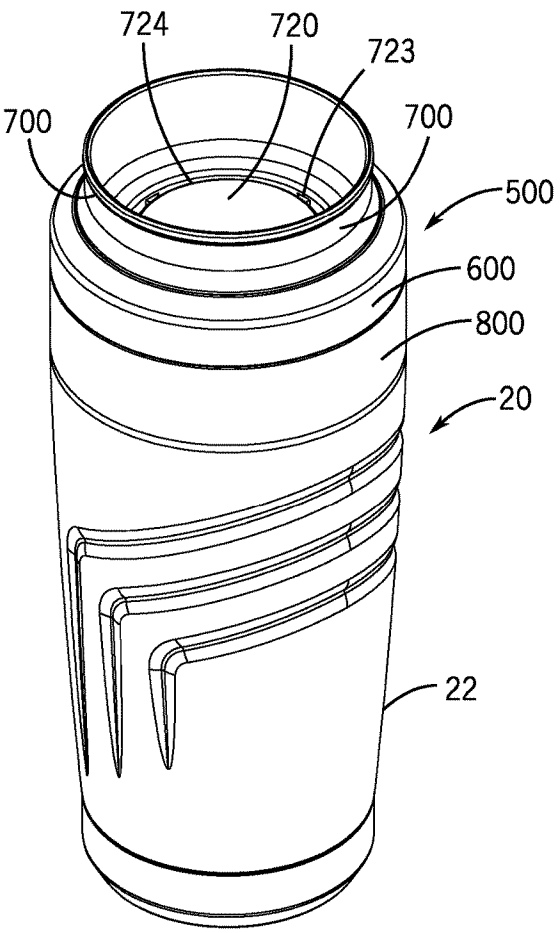
FIG. 11 is a perspective view of another embodiment showing a beverage container a lid assembly.

With respect to FIG. 8, the flow of liquid from the container main body 12 and through the lid assembly 100 is illustrated by four directional arrows. To stop flow or decrease the amount of the flow through the spout 300, the spout 300 is urged downward by turning the outer ring 200 in a given direction, and the lower circular end 316 moves towards the bottom surface 416 of the base member 400 by driving the seal 312 along the internal bore surface 412. The movement of the spout 300 can be continuous, until the lower circular end 316 of the spout 300 touches and presses against the resilient gasket 418. As such, the passage through the openings 420 and the lower opening end of the spout 300 is gradually reduced, thus reducing the amount of the liquid and air flow. Further, the flow of the liquid and air is stopped when the passage is closed up when the lower circular end 316 is entirely against the gasket 418. Further, the lower circular end 316 touches against the flange 414 to provide further closure of the liquid and air passage by blocking the openings 420 to prevent leakage and evaporation. In some aspects, at least one upward protruding member 424 from the flange 414 is further provided for stopping the downward movement of the spout 300, in addition to stopping the spout 300 by the opposite force from the resilient gasket 418.

To start or increase the flow amount through the spout 300, the spout 300 is driven upward by turning the outer ring 200 to another given direction. As such, the lower circular end 316 moves away from the bottom surface 416 of the base member 400 by rotating the seal 312 towards the upper portion of the internal bore surface 412. Such movement of the spout 300 can be continuous, until the tension from the resilient gasket 418 is entirely released and the maximum passage through the openings 420 and the lower circular end 316 of the spout 300 is formed to allow the flow of the liquid and air. Then, the liquid travels along the internal cylindrical surface 306 to the mouth portion 308 of the spout and, often, into the mouth of the user.

The container main body 12 may be made from any suitable material, including a generally rigid material, a generally flexible material, a generally insulated material, or a generally non-insulated material. Examples of container main body materials include metal (e.g., stainless steel), glass, rubber, silicone, plastic (e.g., food grade plastic), or any combination thereof. An insulated material may include a double-wall vacuum insulated construction or foam insulation.

In FIG. 11 through FIG. 17, a numerical symbol "20" represents, as a whole, a beverage container system of the present disclosure. The beverage container system 20 includes a number of features well-suited for the drinking of hot beverages, such as coffee or tea. Of course, cold beverages may also be consumed from the beverage container system 20.

The beverage container system 20 includes a container main body 22 and a lid assembly 500. The container main body 22 includes a container mouth 21 defining a container opening 21A. The lid assembly 500 includes an outer ring 600, a spout 700, a base member 800, and an inner member 900. The outer ring 600, spout 700, base member 800, and inner member 900 may all be disassembled for cleaning. The lid assembly 500 opens and closes the container main body 22 to prevent or allow the flow of liquid from the main body 22. The beverage container system 20 of FIGS. 11-17 operates similarly to the beverage container system 10 of FIGS. 1-10, i.e., the user rotates the outer ring 600 to drive the spout 700 relative to a base side wall 962, which may form a bore 911 of the inner member 900, to open and close the beverage container 20 by directing a lower surface of the spout 700 to a bottom of the bore 911.

Figure 16:
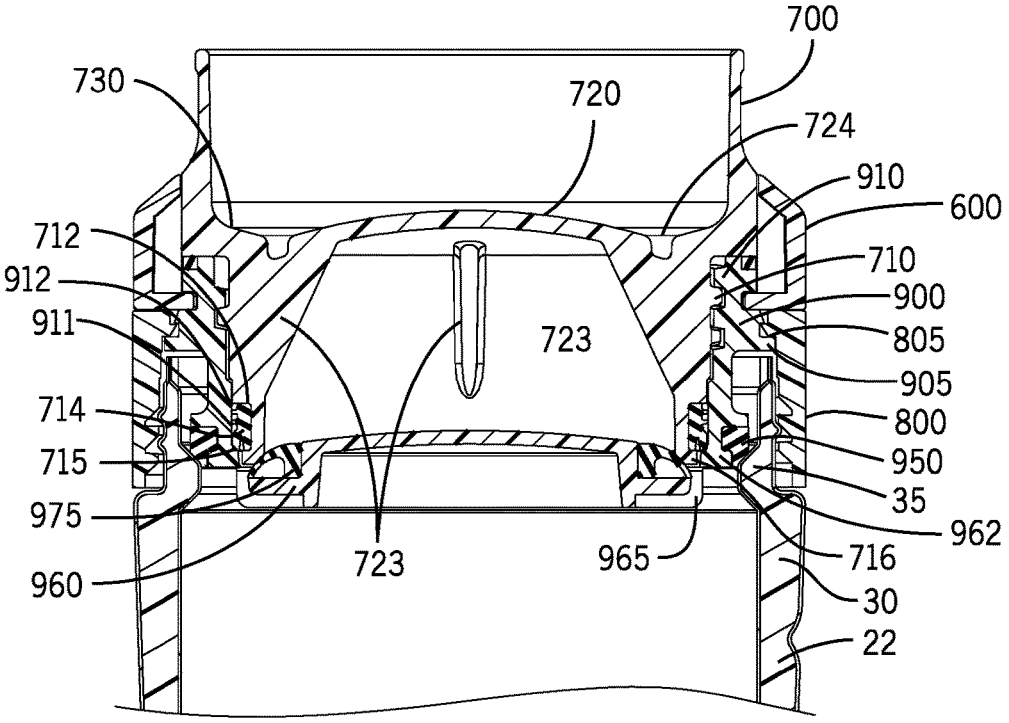
FIG. 16 is a cross-sectional view of another embodiment showing that the spout is moved downward and pressed against the gasket to close the openings for the beverage container.
Figure 17:
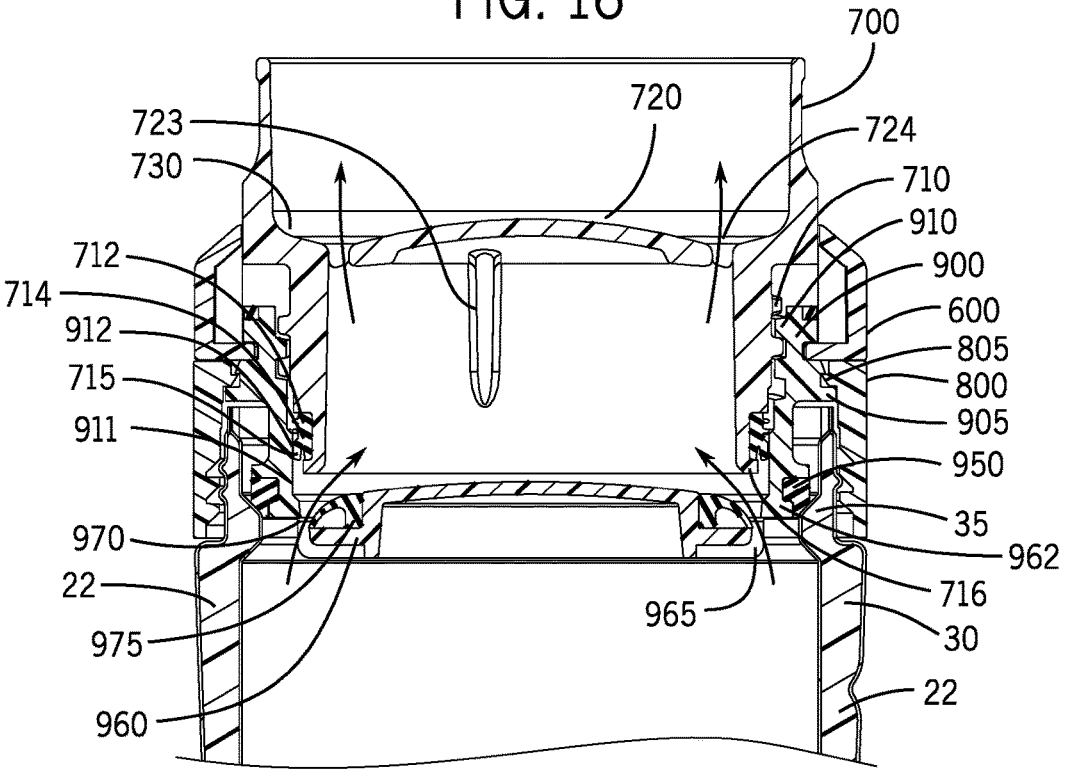
FIG. 17 is a cross-sectional view of another embodiment showing the spout is moved upward and away from the gasket to expose the openings for the beverage container.

The base member 800 threadably engages to an exterior of the container opening 21A of the container main body 22. The base member 800 holds the inner member 900 to the container main body 22. With reference to FIGS. 16 and 17, an inner extending flange 805 of the base member 800 tightens against an outer extending flange 905 of the inner member 900 to secure the inner member 900 to the container main body 22.

Figure 13:
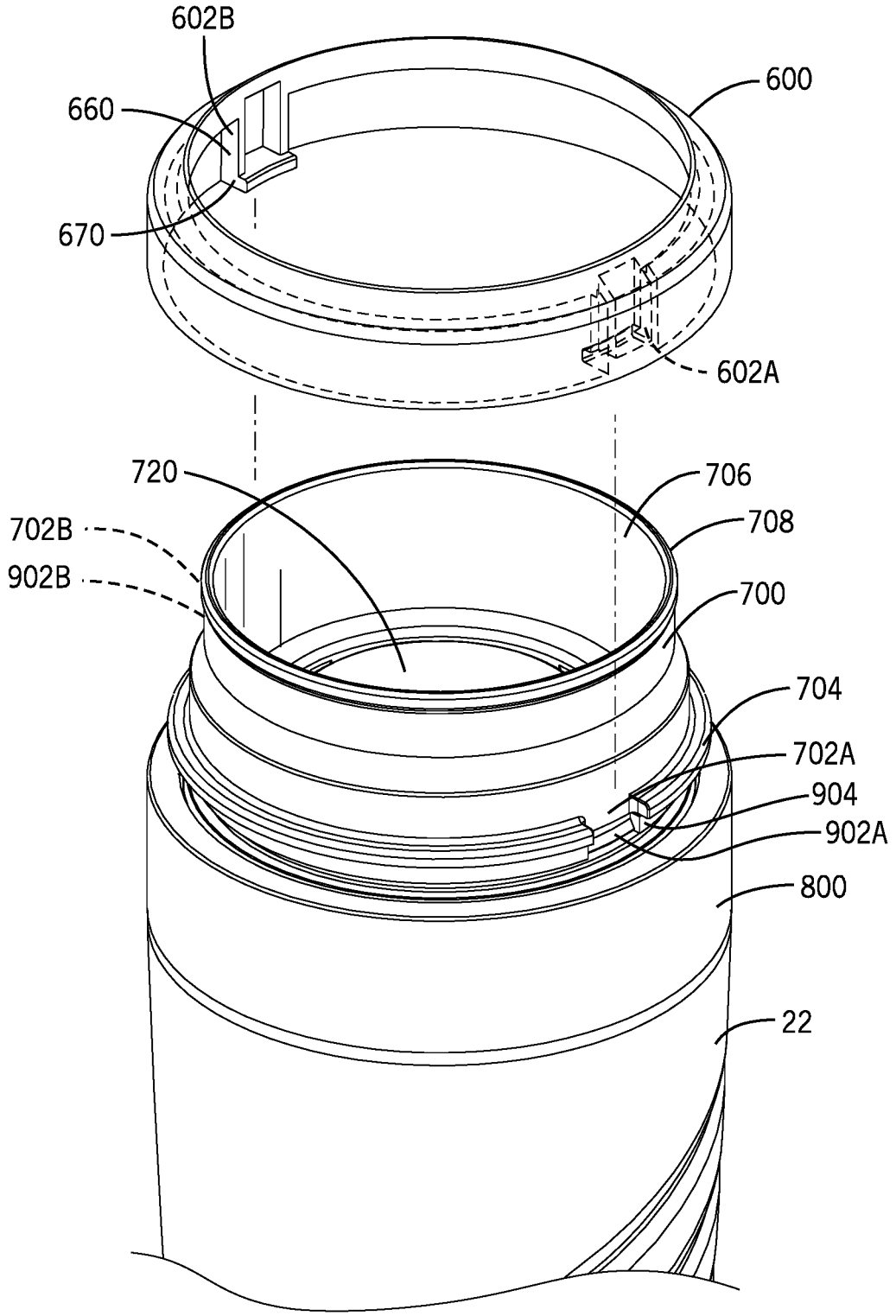
FIG. 13 is a perspective view of another embodiment of the outer ring detached from the lid assembly with engaging members lined up with the receiving members on the beverage container.
Figure 18:
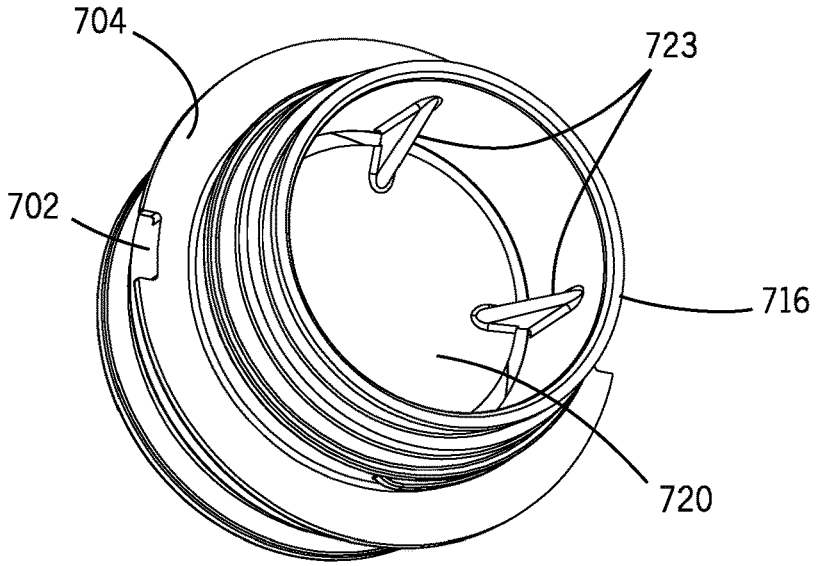
FIG. 18 is an enlarged perspective bottom view of a spout of another embodiment.

With reference to FIG. 13, the spout 700 includes a receiving member 702 formed in a protruding outer edge 704. The receiving member 702 may be an opening, slot, recess, etc. in the protruding edge 704 of the spout 700. The spout 700 further includes an internal cylindrical surface 706 and a mouth portion 708. The spout 700 includes an engagement section 710 that matches with an engagement section 910 of the inner member 900. The spout 700 may threadably engage with the inner member 900. The spout includes a groove 712 to hold a seal 714. The spout 700 further includes a partial covering 720 with cover openings 724. The cover openings 724 and the partial covering 720 slow the release of the beverage from the container main body 22. The cover openings 724 may be a continuous 360 degree opening around the interior of the spout 700, or may include various serial cover openings around most of the spout 700. The cover openings 724 may be broken up by cover support members 723. From the cover openings 724, the spout 700 transitions with an angled surface 730 to further slow the flow of hot beverages. The angled surface 730 helps direct the beverage along the internal cylindrical surface 706 of the spout 700 to slow the beverage. The spout 700 further includes a lower end circular surface 716 that urges against the inner member 900 to close the lid assembly 500. As shown in FIG. 18, certain aspects of the spout 700 may include the partial covering 720, positioned or otherwise supported by the cover support members 723.

Figure 19:
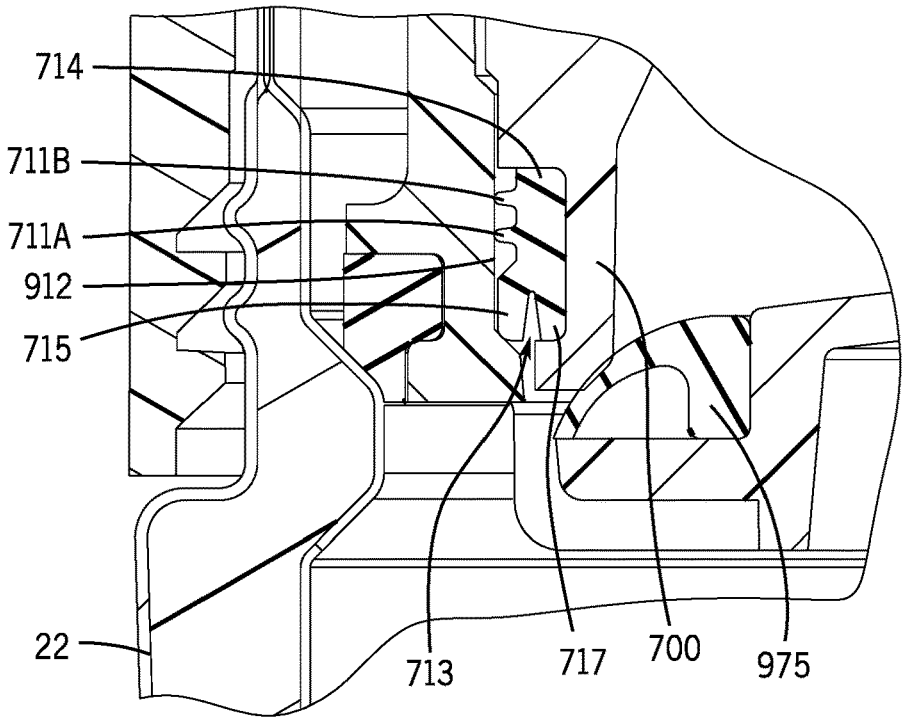
FIG. 19 is an enlarged cross-sectional view of the cut out portion shown in FIG. 17.

A close-up view of the seal 714 and its surrounding components is illustrated in FIG. 19. The seal 714 may include a multi-part design, such as the seal 714 with a projection 711 (or a first projection 711A and second projection 711B), an extending fin 715, and a base fin 717. The seal 714 meets with an external surface of the spout 700 and the bore 911 of the inner member 900. The extending fin 715 is biased toward an internal bore surface 912 of the bore 911, which improves its sealing function to minimize leakage of liquid when the lid assembly 100 is in the closed position. The extending fin 715 and the base fin 717 are configured to define a fin space 713. As pressure builds up in the space defined by the container main body 22 and the closed lid assembly 100 (when the lid assembly 100 is closed and attached to the container main body 22), the air pressure pushes against the fins 715, 717, thereby expanding the fin space 713 and further closing any gap between the extending fin 715 and the internal bore surface 912.

The inner member 900 includes a receiving member 902, which may be an opening, slot, recess, etc. in a protruding portion 904 of the inner member 900. The inner member 900 defines the bore 911 to receive the spout 700. On its inner surface, the inner member 900 forms the internal bore surface 912.

The inner member 900 positions a gasket 950 between the inner member 900 and an inner wall 30 of the container main body 22. The gasket 950 is positioned at an inwardly projecting portion 35 of the inner wall 30. The inwardly projecting portion 35 forms a flange or lip for the gasket 950 to seal against, thereby minimizing leakage of liquid when the lid assembly is positioned on the container main body 22. The inner member 900 is compressed by the base member 800 as the base member 800 tightens to the container main body 22.

The inner member 900 includes a bottom surface 960. Flanges 965 connect the inner member 900 with the base side wall 962. Openings 970 are formed between the flanges 965 and the bottom surface 960 and the base side wall 962. The bottom surface 960 supports a gasket 975, which may be disc-shaped and run only around the top perimeter of the bottom surface 960 in some aspects. The lower end circular surface 716 of the spout 700 seals against the disc-shaped gasket 975 when the outer ring 600 is rotated to the closed position in order to block or close the openings 970. The disc-shaped gasket 975 generally closes the gap between the bottom surface 960 and the lower end circular surface 716 of the spout 700 when the lid assembly is in the closed position.

The outer ring 600 includes at least one engaging member 602 that fits into or with the receiving member 702 of the spout 700 and further with the receiving member 902 of the inner member 900. The engaging member 602 is held in a rotatable engagement with structures of the inner member 900. The engaging member 602 engages with the spout 700 and drives the rotation of the spout 700 relative to the inner member 900. In the aspect shown in FIGS. 11-17, a first engaging member 602A is generally opposite of a second engaging member 602B, a first receiving member 702A is generally opposite of a second receiving member 702B, and a first receiving member 902A is generally opposite of a second receiving member 902B.

Figure 14:
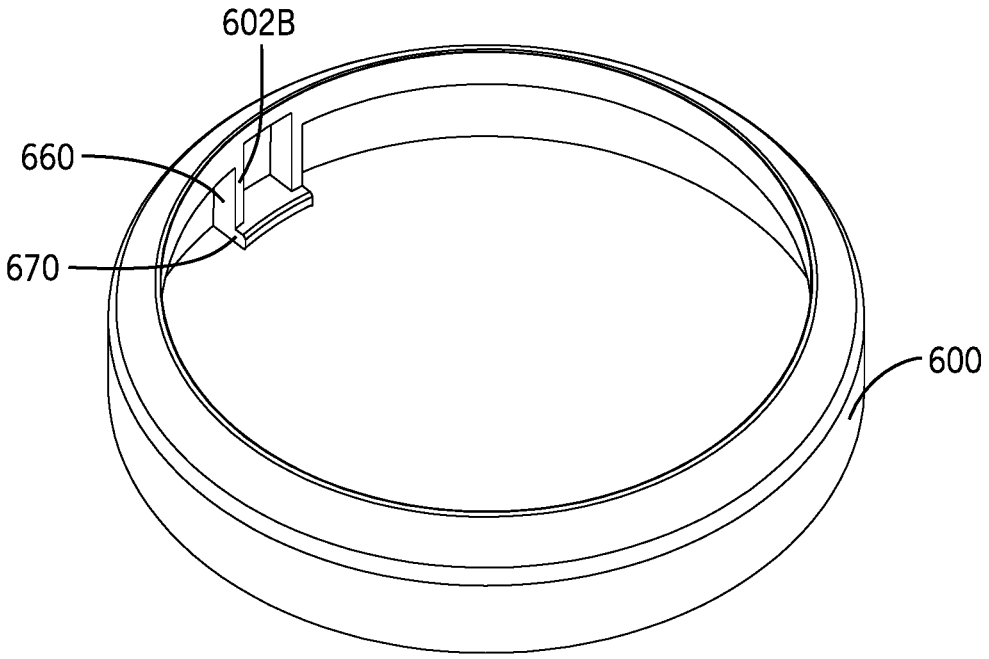
FIG. 14 is an enlarged perspective top view of another embodiment showing the outer ring and the engaging members for the beverage container.
Figure 15:
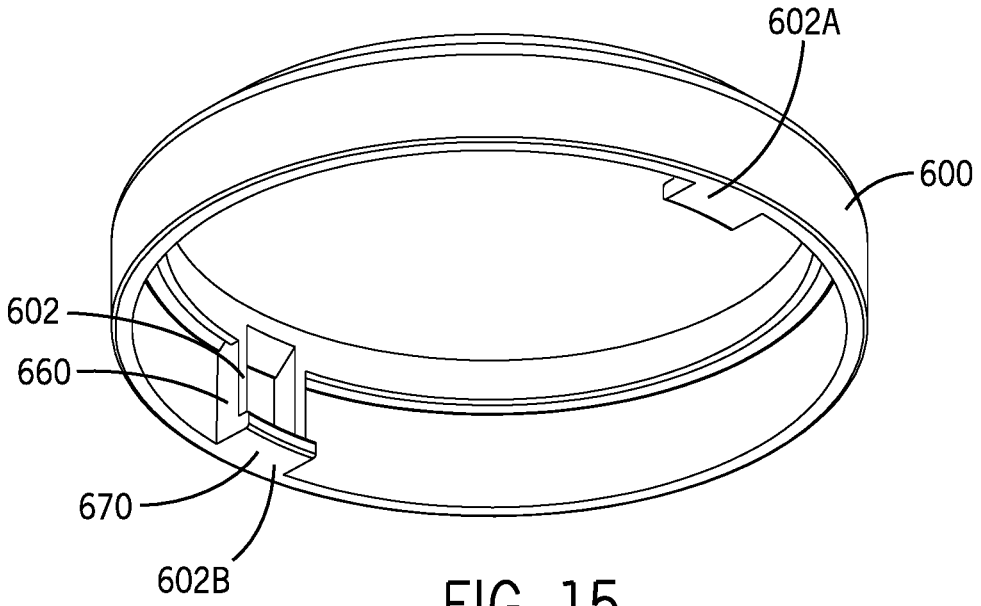
FIG. 15 is an enlarged perspective bottom view of another embodiment showing the outer ring and the engaging members for the beverage container.

With reference to the aspect illustrated in FIGS. 14 and 15, the engaging member 602 includes an "L" shape with a vertical portion 660 and a horizontal portion 670. The horizontal portion 670 of the engaging member extends inwardly a greater distance the vertical portion 660. With reference to FIG. 13, the horizontal portion 670 of the engaging member 602 fits through the receiving members 702 and 902. Upon rotation of the outer ring 600, the horizontal portion 670 rotates under the protruding portion 904 of the inner member 900 and the vertical portion 660 rotates against the protruding portion 904. The protruding portion 704 of the spout 700 extends or protrudes further from a center axis of the container main body 22 than the protruding portion 904. Thus, the vertical portion 660 wedges in the receiving member 702 of the protruding portion 704 of the spout 700 and drives the rotation of the spout 700 relative to the inner member 900. The horizontal portion 670 locks under the protruding portion 904 of the inner member 900 to secure the outer ring 600 to the inner member 900 in a rotational engagement, while the vertical portion 660 slides against or proximate to an exterior of the protruding portion 904 of the inner member 900.

In some other aspects, one of skill in the art can modify the size of different parts disclosed above to determine the extent of the retraction or extension of the spout, and thus the amount of the flow. With the benefit of the present disclosure, one of skill in the art also understands how to intermittently choose the flow amount of the liquid based on a pre-setting. It should be understood that the disclosure is not limited to the particular aspects described herein, but that various changes and modifications may be made without departing from the spirit and scope of this novel concept as defined by the following claims. Further, many other advantages of applicant's disclosure will be apparent to those skilled in the art from the above descriptions and the claims below.

What is claimed is:

1. A lid assembly for a beverage container configured to achieve an open position to permit a user to drink liquid therethrough and achieve a closed position that generally limits the liquid passage therethrough, the lid assembly comprising:

a spout having a mouth portion and a lower circular end positioned generally opposite the mouth portion, wherein the mouth portion is configured to receive the user's lips, and the spout having a threaded engagement section;

a base member having a bottom surface, a base side wall, and flanges, wherein the bottom surface, the base side wall, and the flanges define openings that permit passage of liquid when the lid assembly is in the open position and wherein the lower circular end of the spout meets with the bottom surface to block the passage of liquid through the openings when the lid assembly is in the closed position, and the base member has a threaded engagement section to receive the threaded engagement section of the spout, and the base member configured to engage to a beverage container;

an outer ring removably engaged to the spout, the outer ring configured to permit the user to maneuver the spout and the base member relative to each other to achieve the open position and the closed position, such that the user does not have to directly touch the spout to achieve the open position or the closed position, which decreases contamination of the mouth portion of the spout; and, the spout includes an internal cylindrical surface and an external cylindrical surface, the external cylindrical surface includes a groove configured to hold a seal and position the seal generally against an internal surface of the base side wall when the spout moves to transition between the open position and the closed position, thereby minimizing the liquid that can pass between the base member and the spout.

2. The lid assembly according to claim 1, wherein the openings are sized and shaped to generally block the passage of relatively chunky additives therethrough, even when the lid assembly is in the open position.

3. The lid assembly according to claim 1, wherein the spout is removably engaged to the base member.

4. The lid assembly according to claim 1, wherein a rotation of the outer ring and the spout relative to the base member locks the outer ring and the spout to the base member.

5. The lid assembly according to claim 1, wherein the base member receives the spout by a rotational motion.

6. The lid assembly according to claim 1, wherein the seal of the spout is selected from an angular seal, a radial seal, or double lip seal.

7. The lid assembly according to claim 1, wherein the seal includes an extending fin and a base fin, the fins configured to define a fin space, wherein the fin space is increased when air pressure builds up in container space thereby pushing the extending fin against an internal surface of the base side wall and further closing any gap between the internal surface of the base side wall and that extending fin.

8. The lid assembly according to claim 1, wherein the lid assembly includes a gasket generally positioned in or above the bottom surface such that the gasket improves the blocking function of interaction between the lower circular end of the spout and the bottom surface when the lid assembly is in the closed position.

9. The lid assembly according to claim 8, wherein the gasket is generally mushroom shaped.

10. The lid assembly according to claim 8, wherein the gasket is generally disc shaped and positioned generally around a top perimeter of the bottom surface.

11. The lid assembly according to claim 1, wherein the outer ring includes one or more engaging members configured to fit into a complementary receiving member on the spout, thereby forming a removable connection between the outer ring and the spout such that maneuvering the outer ring affects the position of the spout.

12. The lid assembly according to claim 11, wherein the base member includes one or more base receiving members configured to receive the one or more engaging members of the outer ring.

13. The lid assembly according to claim 1, wherein the spout has a partial covering including covering openings, such partial covering configured to further slow the flow of liquid to the user and positioned generally below or otherwise near the mouth portion of the spout.

14. The lid assembly according to claim 1, wherein the base member includes an inner member and an outer member.

15. The lid assembly according to claim 1, wherein the openings are positioned around a bottom surface of the base member, thereby permitting the user to drink from anywhere on the mouth portion.

16. The lid assembly according to claim 1, together with the beverage container.

17. A lid assembly for a beverage container, comprising:

a base member, the base member forming a bore with an internal bore surface, a flange positioned in a lower portion of the bore, a beverage opening formed between the bore and the flange, the base member forming a first protruding edge, and the first protruding edge having a first opening that forms a first receiving member;

an outer ring to rotatably engage with the base member, the outer ring forming an engaging member;

a spout to rotatably engage with the base member, the spout comprising a mouth portion, an external cylindrical surface, and a lower circular end opposite of the mouth portion, the spout forming a second protruding edge, and the second protruding edge having a second opening that forms a second receiving member, a seal extending from the external cylindrical surface to seal against the internal bore surface of the base member;

the engaging member of the outer ring passes through the second receiving member of the spout and engages with the first receiving member of the base member; and, the outer ring to rotate the spout relative to the base member to move the lower circular end towards and away from the beverage opening.

* * * * *